US006338334B1

(12) United States Patent
Ando

(10) Patent No.: US 6,338,334 B1
(45) Date of Patent: Jan. 15, 2002

(54) FUEL PIPING STRUCTURE FOR DIESEL ENGINE

(75) Inventor: Hatsuo Ando, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/536,995

(22) Filed: Mar. 29, 2000

(30) Foreign Application Priority Data

Mar. 31, 1999 (JP) ..... 11-092405

(51) Int. Cl.[7] ..... F02M 33/04
(52) U.S. Cl. ..... 123/456; 123/468; 123/469
(58) Field of Search ..... 123/456, 468, 123/469, 514, 541

(56) References Cited

U.S. PATENT DOCUMENTS 5,163,406 A * 11/1992 Daly et al. ..... 123/456
5,297,524 A * 3/1994 Franssone et al. ..... 123/468
5,299,540 A * 4/1994 Fransson et al. ..... 123/168
5,611,313 A * 3/1997 Ashcraft ..... 123/456
5,743,235 A * 4/1998 Lueder ..... 123/468
5,934,252 A * 8/1999 Hafner et al. ..... 123/468

FOREIGN PATENT DOCUMENTS

JP 6-207565 7/1994

* cited by examiner

*Primary Examiner*—Thomas N. Moulis
(74) *Attorney, Agent, or Firm*—Armstrong, Westerman, Hattori, McLeland & Naughton, LLP

(57) ABSTRACT

A fuel piping structure for a diesel engine, which is capable of cooling fuel which is flowing through a fuel circuit, especially, through a fuel return circuit, and capable of making the fuel circuit compact in size, is provided. For this purpose, in the fuel piping structure for the diesel engine in which the fuel circuit is provided between a fuel tank (5) and fuel injection nozzles (2) each for each cylinder head (1), a part of the fuel circuit is formed inside an intake manifold (3). Further, the part of the fuel circuit may be a part of a fuel return circuit running from the fuel injection nozzles (2) to the fuel tank (5), and/or a part of a fuel supply circuit running, from the fuel tank (5) to the fuel injection nozzles (2).

8 Claims, 5 Drawing Sheets

FIG. 2

| ITEM | ENGINE A | ENGINE B |
|---|---|---|
| PISTON DISPLACEMENT (ℓ) | 23 | 19 |
| CYLINDER DIAMETER (mm) | 170 | 150 |
| FUEL SUPPLY CIRCUIT LENGTH max. (mm) | 1274.7 | 1795 |
| FUEL SUPPLY CIRCUIT LENGTH min. (mm) | 1043.7 | 1187 |
| FUEL SUPPLY CIRCUIT LENGTH RATIO max./min. | 1.221 | 1.512 |
| FUEL SUPPLY CIRCUIT VOLUMETRIC CAPACITY max. (ml) | 120 | 122 |
| FUEL SUPPLY CIRCUIT VOLUMETRIC CAPACITY min. (ml) | 98 | 82 |
| FUEL SUPPLY CIRCUIT VOLUMETRIC CAPACITY RATIO max./min. | 1.224 | 1.488 |

FUEL PIPING STRUCTURE FOR DIESEL ENGINE

TECHNICAL FIELD

The present invention relates to a fuel piping structure for a diesel engine.

BACKGROUND ART

The following structures are each known as a fuel circuit for supplying fuel to a fuel injection nozzle located in each cylinder of a diesel engine and for returning excess fuel into a fuel tank.

(1) An Engine of a Separate Cylinder Head Structure

A fuel manifold is attached on side faces of separated cylinder heads, and fuel is supplied from the fuel manifold to each fuel injection nozzle while excess fuel is returned. FIG. 7 schematically shows an example of a fuel circuit in a six-cylinder in-line diesel engine of a separate cylinder head structure, in which fuel injection nozzles 22 are respectively placed in six cylinder heads 21 each independently provided for each cylinder. A front side fuel manifold 23 is fastened to side faces of No. 1 to No. 3 cylinder heads 21, and a rear side fuel manifold 24 is fastened to side faces of No. 4 to No. 6 cylinder heads 21, out of the aforesaid cylinder heads 21. In FIG. 7, the front side fuel manifold 23 and the rear side fuel manifold 24 are shown by the diagonally shaded areas.

A fuel supply bore 23*a*, fuel supply bores 23*b* branching from the fuel supply bore 23*a* toward the respective injection nozzles 22, a fuel return bore 23*c*, and fuel return bores 23*d* branching form the fuel return bore 23*c* toward the respective injection nozzles 22 are provided inside the front side fuel manifold 23. The fuel supply bore 23*b* and the fuel return bore 23*d* are respectively connected to a fuel supply bore 21*a* and a fuel return bore 21*b* provided in each of the cylinder head 21. On the contact faces of each cylinder head 21 and the front side fuel manifold 23, O-rings not shown are respectively attached between the contact portions of the fuel supply bore 23*b* and the fuel supply bore 21*a*, and between the contact portions of the fuel return bore 21*b* and the fuel return bore 23*d*. Further, the relationships between the fuel circuit provided inside the rear side fuel manifold 24 and the cylinder heads 21 are identical to the case of the front side fuel manifold 23, thus omitting the explanation thereof.

An intake manifold 25 is also fastened to the side face of each cylinder head 21. As a result, a fuel supply line 29, which runs from a fuel tank 26 by way of a fuel filter 27 and a fuel pump 28, branches in the longitudinal direction of the paper face of FIG. 7, and goes around a front end and a rear end of the intake manifold 25 to be connected to a front end of the front side fuel manifold 23 and a rear end of the rear side fuel manifold 24 respectively. Fuel return lines, which are connected to the front end of the front side fuel manifold 23 and the rear end of the rear side fuel manifold 24 respectively, are combined into one fuel return line 30, and thereafter it is connected to the fuel tank 26 via a fuel cooler 31.

(2) An Engine with an Integral-type of Cylinder Head Structure

In this case, a fuel manifold as in the above item (1) is adopted, or common-supply-and-return-fuel-lines which run through each cylinder are provided inside a cylinder head, thereby directly connecting external lines to the fuel manifold or the common fuel lines.

(3) In a fluid circuit for an engine cylinder head, which is proposed by the present inventor and disclosed in Japanese Patent Application Laid-open No. 6-207565, an engine with a separate cylinder head structure is used. However, the fuel manifold is not used, and a fuel circuit is formed by connecting fuel supply lines each provided inside a rocker housing of each cylinder, and fuel return lines, with pipes respectively.

However, the above prior arts have the following disadvantages.

(1) The Disadvantage Common to the Respective Kinds of Engine Explained in the Prior Art.

Since the fuel circuit is not cooled by the fluid (for example, air, water, and the like) inside the engine, the temperature of fuel (specifically, excess fuel) cannot be reduced. Accordingly, in order to cool the fuel, a fuel cooler of large capacity has to be additionally placed.

(2) The Disadvantage Regarding the Fuel Manifold

A fuel manifold is generally manufactured by extrusion molding of aluminum material (plastic processing), and an O-ring is incorporated in order to prevent fuel leak at the contact portions of the fuel manifold and the cylinder head. However, since the fuel manifold is long, it is difficult to secure flatness on the surface scaled by the O-ring, and the O-ring is easy to come off during assembly. Consequently, there is the disadvantage of fuel seal being less reliable.

(3) The Disadvantage Regarding the Common Fuel Line Provided Inside the Cylinder Head This is used in an engine with an integral-type of cylinder head structure, but if this is used in a large-sized engine with a separate cylinder head structure which is generally adopted, it is extremely difficult to provide a common fuel line, which runs through each cylinder, inside the cylinder head.

(4) The Disadvantage Regarding Japanese Patent Application Laid-open No. 6-207565

The art disclosed in Japanese Patent Application Laid-open No. 6-207565 is one of the means for overcoming the above disadvantages. However, since a fuel cooling function is not included in the art, it is necessary to additionally provide a fuel cooler of large capacity in order to cool fuel.

SUMMARY OF THE INVENTION

In view of the above disadvantage of the above prior art, the present invention is made, and its object is to provide a fuel piping structure for a diesel engine capable of cooling fuel (including excess fuel) flowing through a fuel circuit of a fuel injection system, and capable of making the fuel circuit compact in size.

A fuel piping structure for a diesel engine according to the present invention is a fuel piping structure for a diesel engine in which a fuel circuit is provided between a fuel lank and fuel injection nozzles each for each cylinder head, and is characterized in that a part of the fuel circuit is formed inside an intake manifold.

According to the above configuration, since a part of the fuel circuit is formed inside the intake manifold, that is, the intake manifold is used for a dual purpose, the fuel manifold conventionally used becomes unnecessary. As a result, a component configuration and piping structure on the side of the cylinder head, to which the intake manifold is mounted, are simplified, and thus the engine can be made compact in size.

Further, in the fuel piping, structure, the part of the fuel circuit may be a part of a fuel return circuit running from the fuel injection nozzles to the fuel tank.

According to the above structure, since a part of the fuel return circuit running from the fuel injection nozzles to the fuel tank is formed inside the intake manifold, excess fuel is cooled by air flowing through the intake manifold. The cooling effect becomes especially large when an engine with a system in which air compressed by a supercharger is cooled by means of an after-cooler. Since excess amount of fuel (specifically, excess fuel) which is pressurized to he heated to a high temperature is efficiently cooled inside the intake manifold when returning to the tank, the fuel cooler, which is conventionally indispensable, can be withdrawn from service or downsized. Further, the temperature of the fuel tank decreases with falling temperature of the excess fuel, thus improving, safety.

Furthermore, in the fuel piping structure for the diesel engine, the part of the fuel circuit may be a part of a fuel supply circuit running from the fuel tank to the fuel injection nozzles.

According to the above configuration, since a part of the fuel supply circuit is formed inside the intake manifold, the fuel manifold conventionally used becomes unnecessary. As a result, the component configuration on the side of the cylinder head, to which the intake manifold is mounted, can be simplified. Further, since the fuel supply piping structure is simplified, a useless part of the piping volume is eliminated, and load on the fuel pump can be reduced.

Further, in the fuel piping structure for the diesel engine, at least one of the part of the fuel supply circuit may be formed inside the intake manifold, and fuel supply lines, which are provided between the fuel tank and the part of the fuel supply circuit at least one of which is formed, may be connected to approximately center portions in longitudinal directions of the part of the fuel supply circuit at least one of which is formed.

According to the above configuration, the fuel piping provided between the fuel tank and the intake manifold can be drastically shortened to be placed compared to the prior art. As a result, useless volume of the fuel line can be eliminated, and the fuel line can be simplified in shape and downsized. Further, significant imbalance is eliminated and the balance is achieved in the distances from the connection portion of the fuel circuit with the intake manifold to the fuel injection nozzles, thereby reducing variations in the amount of injection in each cylinder, and improving the engine performance.

Furthermore, in the fuel piping structure, at least one of the following: longitudinal portions of the intake manifold, which are in the part of the fuel supply circuit; and longitudinal portions of the intake manifold, which are in the part of the fuel return circuit, may be machined and formed from both ends of the intake manifold in the longitudinal direction thereof.

According to the above configuration, the fuel supply circuit and/or the fuel return circuit are/is separately machined from both ends of the intake manifold in the longitudinal direction thereof, thus making a necessary stroke of a work machine smaller, facilitating machining, and finishing machining, in a short time. In addition, each fuel circuit can be shortened, and a useless volume of the fuel circuit can be eliminated, thus reducing load on the fuel pump. In addition, variations in the amount of injection in each cylinder are reduced, and the engine performance can be improved.

Further, in the fuel piping structure, an intake manifold gasket, which is attached between contact faces of the intake manifold and the cylinder head, and has fuel holes for connecting the fuel circuits respectively formed in the intake manifold and the cylinder head, may be included, and each of the fuel holes may be formed by a rubber seal which is integrally fixed to the intake manifold gasket.

According to the above structure, the rubber seal is added to the conventional air scaling intake manifold gasket to be integrally fixed thereto for connecting the fuel circuit. As a result, fuel leakage can be surely prevented, and the falling off of an O-ring, is eliminated, which is conventionally the disadvantage when the fuel manifold is mounted, and easiness in assembly can be increased.

BRIEF DESCRIPTION OF THE DRAWINGS

FIG. 2 shows comparison check results of the present invention and a prior art regarding the fuel supply circuit;

BEST MODE FOR CARRYING OUT THE INVENTION

A preferred embodiment of the present invention will be explained with reference to the drawings. An example of a six-cylinder in-line diesel engine will be explained below, but the present invention is not limited thereto.

Figure 1:
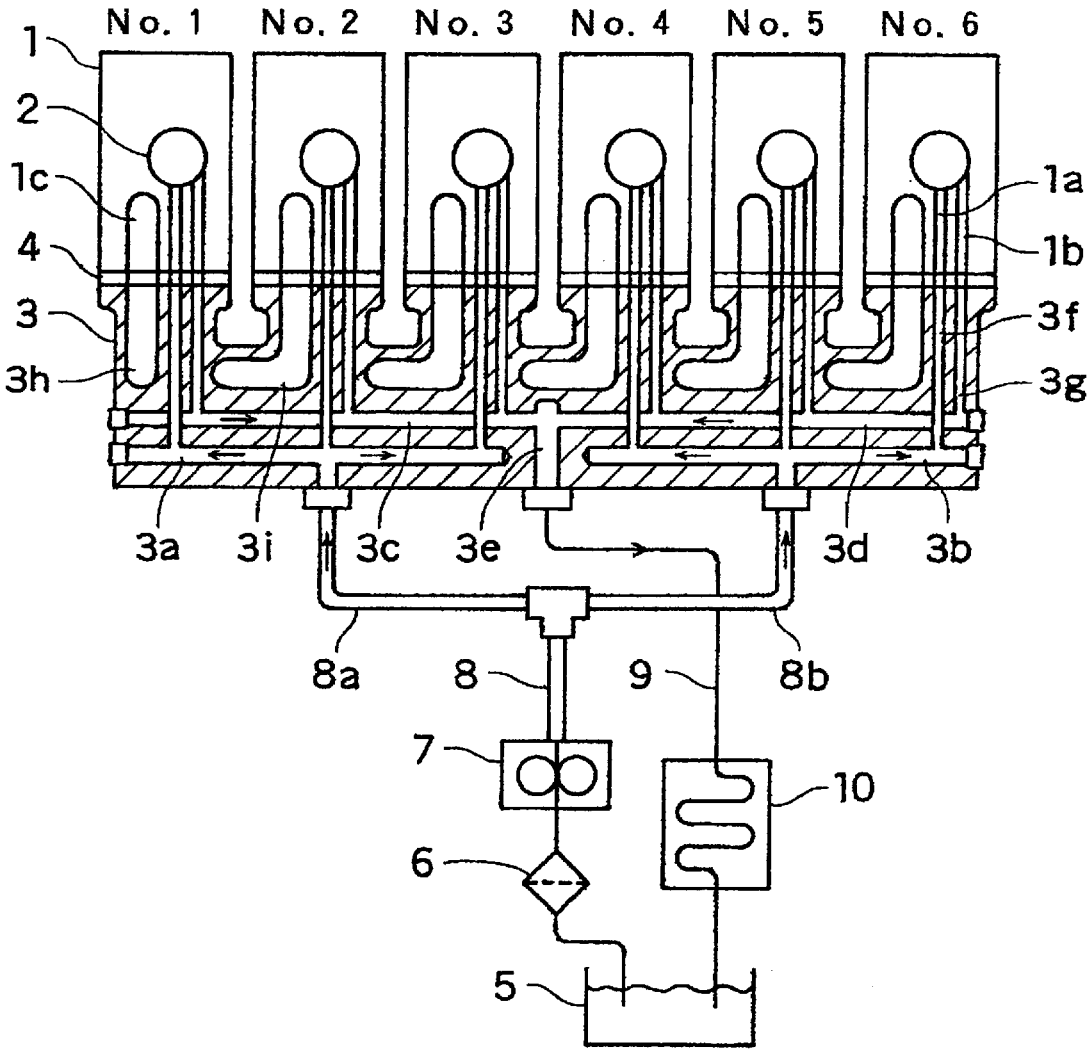
FIG. 1 is a schematic view of an example of a fuel circuit for an engine according to the present invention.

FIG. 1 schematically shows a fuel circuit used in a six cylinder in-line diesel engine having separate cylinder heads each for each cylinder. Each of fuel injection nozzles 2 for injecting fuel to the cylinder is located in each of six cylinder heads 1 which are denoted by No. 1 to No. 6 placed in line. An intake manifold 3 is attached to each cylinder head 1 with an intake manifold gasket 4 therebetween. A fuel supply bore 1*a* and a fuel-return bore 1*b* are provided toward the fuel injection nozzle 2 from a mounting surface for the intake manifold 3. Here, the intake manifold 3 is shown by the diagonally shaded areas in FIG. 1.

Inside the intake manifold 3, a front side fuel supply bore 3*a*, a rear side fuel supply bore 3*b*, a front side fuel return bore 3*c*, and a rear side fuel return bore 3*d* are provided in parallel with the longitudinal direction of the diesel engine. The front side fuel return bore 3*c* and the rear side fuel return bore 3*d* are in communication with each other inside the intake manifold 3, and are in communication with a middle fuel return bore 3*e* provided in a direction orthogonal to the front side fuel return bore 3*c* and the rear side fuel return bore 3*d* almost at the center portion of the diesel engine. Three cylinder fuel supply bores 3*f* (consequently, six in total) are provided at each of the front side fuel supply bore 3*a* and the rear side fuel supply bore 3*b* toward the respective fuel injection nozzles 2. Three cylinder fuel return bores 3*g* (consequently, six in total) are provided at each of the front side fuel return bore 3*c* and the rear side fuel return bore 3*d* toward the respective fuel injection nozzles 2. The position where each cylinder fuel supply bore 3*f* is provided corresponds to the position of the fuel supply bore 1*a* of the cylinder head 1 on a contact face with the cylinder head 1. The position where each cylinder fuel return bore 3*g* is provided corresponds to the position of the fuel return bore 1*b* of the cylinder head 1 on a contact face with the cylinder head 1. The intake manifold 3 is provided with air passages 3*h* and 3*i* for supplying air into each of the cylinders, and each cylinder head 1 is provided with an air passage 1*c* for serving the same purpose as above.

A fuel supply line 8, which runs from a fuel tank 5 by way of a fuel filter 6 and a fuel pump 7, branches into a front side fuel supply line 8*a* and a rear side fuel supply line 8*b* in the vicinity of the intake manifold 3. The front side fuel supply line 8*a* is connected to approximately the center portion of the front side fuel supply bore 3*a* provided in the intake manifold 3, that is, to the cylinder fuel supply bore 3*f* extending toward the No. 2 cylinder head 1 at the position in which they are almost coaxial. The rear side fuel supply line 8*b* is connected to approximately the center portion of the rear side fuel supply bore 3*b* provided in the intake manifold 3, that is, to the cylinder fuel supply bore 3f extending toward the No. 5 cylinder head 1 at the position in which they are almost coaxial. A fuel return line 9 is connected to the middle fuel return bore 3*e*, and excess fuel in the fuel return line 9 is returned to the fuel tank 5 via a fuel cooler 10. It should be noted that the fuel cooler 10 may be downsized, or the fuel cooler 10 may not be provided as necessary.

The inventor of the present invention determines the length of the fuel supply circuit from a connecting portion to each fuel injection nozzle 2 when connecting the front side fuel supply line 8*a* and the rear side fuel supply line 8*b* respectively to approximately the center portions of the front side fuel supply bore 3*a* and the rear side fuel supply bore 3*b* which are provided inside the intake manifold 3. The engines used here are a six cylinder incline engine according to the present invention with a piston displacement of 23 liters and a cylinder diameter of 170 mm (hereinafter called an engine A), and a six cylinder in-line engine according to a prior art for comparison, with a piston displacement of 19 liters and a cylinder diameter of 150 mm (hereinafter called an engine B). The determination results are shown in FIG. 2. Though the engine A is larger than the engine B, the length of the aforesaid fuel supply circuit can be reduced to he equal to or less than that of the engine B. Further, the length ratio of the fuel supply circuit (=the maximum length of the fuel supply circuit/the minimum length of the fuel supply circuit) is 1.221 for the engine A, and 1.512 for the engine B, which shows that the balance in the length of the fuel supply circuit is improved compared to the conventional engine B. Further, the volume ratio of the fuel supply circuit (=the maximum volume of the fuel supply circuit /the minimum volume of the fuel supply circuit) is 1.224 for the engine A, and 1.488 A for the engine B, which means that the balance is improved as in the length ratio of the fuel supply circuit.

Figure 3:
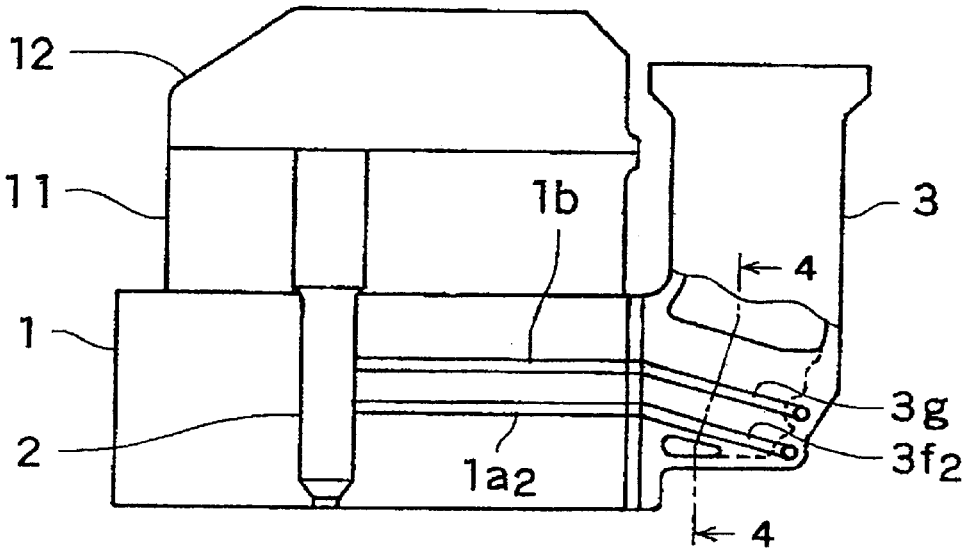
FIG. 3 is a sectional explanatory view of the fuel circuit in a cylinder head and an intake manifold according to the present invention.
Figure 4:
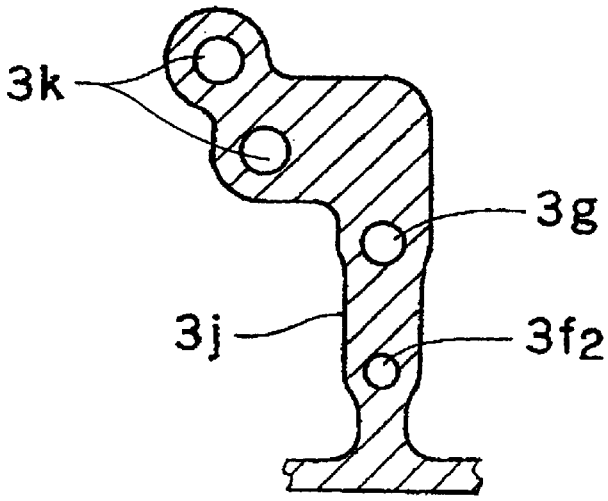
FIG. 4 is a sectional view taken along the 4—4 line in FIG. 3.

FIG. 3 shows a longitudinal section of the fuel circuit from the intake manifold 3 to the fuel injection nozzle 2 inside the cylinder head 1, and FIG. 4 shows a section taken along the 4—4 line in FIG. 3. A rocker housing 11 is fastened onto a top face of the cylinder head 1, and a top face of the rocker housing 11 is covered with a rocker housing cover 12. The cylinder head 1 and the intake manifold 3 are each provided with two fuel bores connected to the fuel injection nozzle 2. A fuel supply bore 1*a*2 and a cylinder fuel supply bore 3*f*2 are injection fuel supply bores, and the fuel return bore 1*b* and a cylinder fuel return bore 3*g* are the return bores for excess fuel. The fuel return bores 3*f*2 and 3*g* provided in the intake manifold 3 are provided inside a fuel boss 3*j* which is protruded into the air passage in the intake manifold 3 as shown in FIG. 4. Air flowing into the intake manifold 3 flows outside the fuel boss 3*j* along the fuel bores 3*f*2 and 3*g*. Two bores 3*k* provided in the fuel boss 3*j* other than the fuel bores 3*f*2 and 3*g* are mounting ports for mounting the intake manifold 3 to the cylinder head 1.

Injection fuel supplied into the fuel injection nozzle 2 is compressed by rock of a rocker arm (not shown), and excess fuel other than consumed injection fuel flows into the fuel tank 5 through the fuel return bores 1*b*, 3*c*, 3*d*, 3*e*, and 3*g*. When passing through the fuel return bore 3*g* and the front side fuel return bore 3*c* or the rear side fuel return bore 3*d*, excess fuel is cooled by air flown into the intake manifold 3. In order to inspect cooling performance according to the configuration of the present invention, fuel temperature was measured with use of an "AIR TO AIR after cooler system" engine in which air compressed by a turbocharger was cooled in the after cooler and sent to an intake manifold. As a result of the measurement, the temperature of excess fuel near the fuel tank was 84.3° C. whereas the temperature of that at the outlet of the cylinder head was 110° C., and about a 26° C. decrease of temperature was seen as a result that the excess fuel passed through the intake manifold. The temperature of the air inside the intake manifold was 51.2° C.

Figure 5:
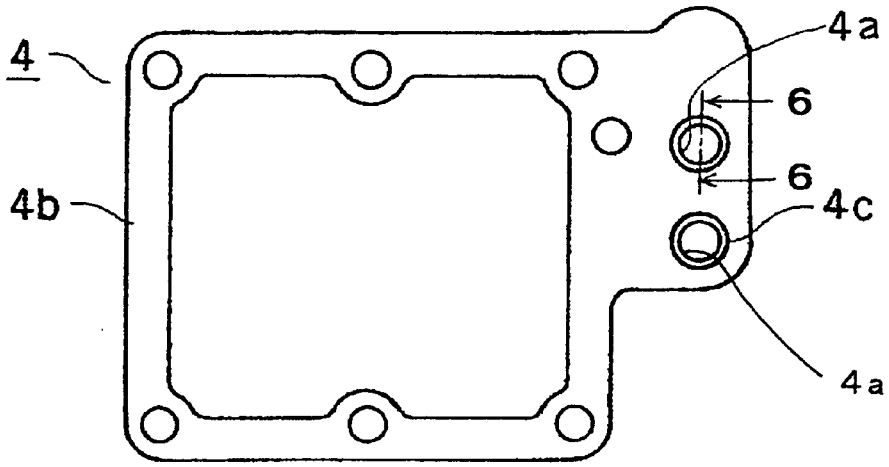
FIG. 5 is a plan view of an intake manifold gasket according to the present invention.
Figure 6:
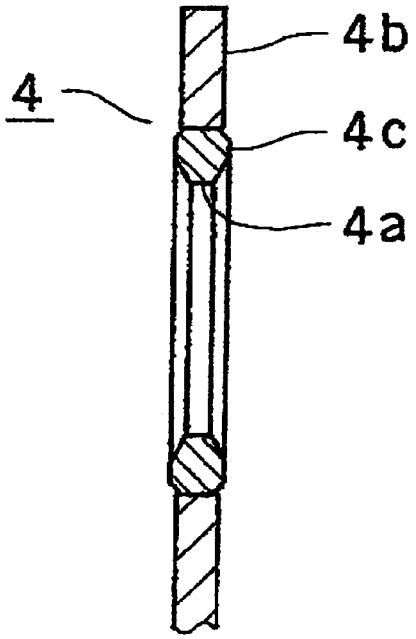
FIG. 6 is a sectional view taken along the 6—6 line in FIG. 5.
Figure 7:
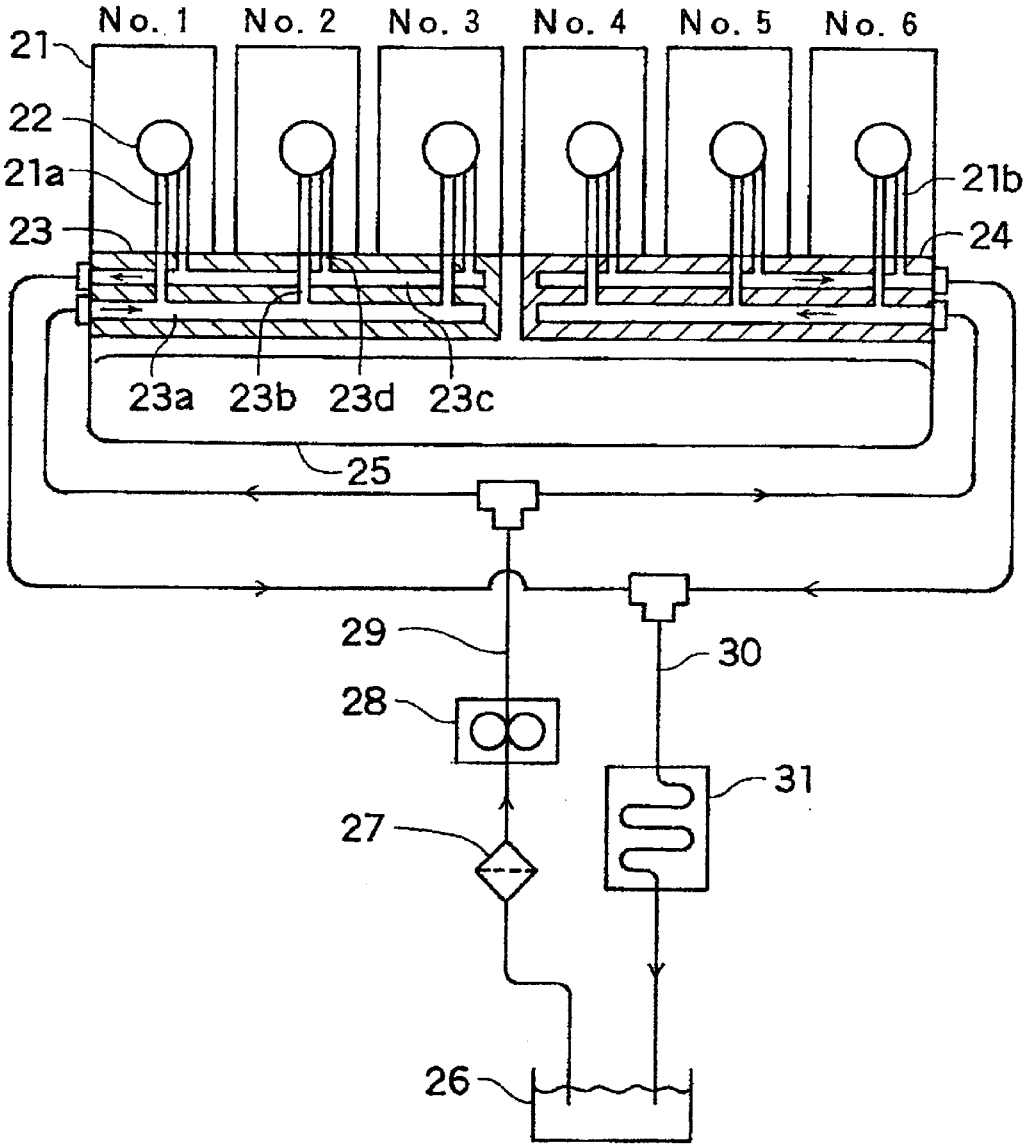
FIG. 7 PRIOR ART
FIG. 7 is a schematic view of an example of a fuel circuit for an engine according to the prior art.

FIG. 5 is a plan view of an intake manifold gasket 4 which is attached between the contact faces of the cylinder head 1 and the intake manifold 3, and FIG. 6 is a sectional view taken along the 6—6 line in FIG. 5. At an end portion of the intake manifold gasket 4, fuel holes 4*a* and 4*a* are respectively provided at the positions corresponding to the connecting portions to the cylinder fuel return bore 3*g* and the cylinder fuel supply bore 3*f*2 (See FIG. 3) as shown in FIG. 5. These fuel holes 4*a* and 4*a* are each formed inside a rubber seal 4*c* (corresponding to an O-ring) which is fitted into and bonded to a hole (the center thereof corresponds to the center of the fuel hole 4*a*) provided in a casket body 4*b*. Since the rubber seal 4*c* is formed integrally with the gasket body 4*b*, when the intake manifold 3 is mounted to the cylinder head 1, the rubber seal 4*c* never comes off. As a result, assembly is made easy and there is no risk that the fuel will leak from a portion between the contact faces of the cylinder head 1 and the intake manifold 3.

As explained thus far, according to the present invention, part of the fuel circuit is formed inside the intake manifold 3 which is also used for taking in air, and thus the fuel manifold conventionally used is made unnecessary. As a result, the component configuration and piping structure on the side of the cylinder heads 1 for mounting the intake manifold 3 are simplified, and the engine can be made compact.

Further, since part of the fuel return circuit from the fuel injection nozzles 2 to the fuel tank 5 is formed inside the intake manifold 3 (for example, the fuel return bores 3*c*, 3*d*, 3*e*, and 3*g* are provided inside the intake manitfold 3), excess fuel is cooled by the air flowing through the intake manifold 3. Accordingly, excess amount of fuel which is pressurized and heated to a high temperature are efficiently cooled in the intake manifold 3 when it returns to the fuel tank 5, therefore making it possible to eliminate or downsize the fuel cooler which is conventionally indispensable. In addition, since the temperature of the fuel tank 5 becomes lower following a decrease in the temperature of the excess fuel, safety is further improved.

Further, since part of the fuel supply circuit is formed inside the intake manifold 3 (for example, the fuel supply bores 3*a*, 3*b*, 3*f*, and 3*f*2, which are used as part of the fuel supply circuit, are provided inside the intake manifold 3), the fuel manifold which is conventionally used is made unnecessary. As a result, the component configuration on the side of the cylinder heads 1 for mounting the intake manifold 3 is simplified. In addition, the fuel supply piping structure can be simplified, thus eliminating the needless part of the piping volume and achieving the balance. Hence, load on the fuel pump 7 can be reduced.

Since the fuel supply lines 8*a* and 8*b*, which arc provided between the fuel tank 5 and the respective fuel supply circuits 3*a* and 3*b* inside the intake manifold 3 are respectively connected to the fuel supply circuits 3*a* and 3*b* at the respective approximately center portions in the longitudinal directions thereof, the fuel line provided between the fuel tank 5 and the intake manifold 3 can be made the shortest. Hence, the needless volume of the fuel line can be eliminated, and the shape of the fuel line can be simplified and downsized. Further, regarding the distances from the connection portion of the fuel circuit with the intake manifold 3 to the fuel injection nozzles 2, the conventional serious imbalance is eliminated so that the balance is achieved, thus reducing variations in the amount of injection of each cylinder, and increasing the performance of the engine.

Further, since the fuel supply circuits 3*a* and 3*b*, and the fuel return circuits 3*c* and 3*d* from the fuel injection nozzles 2 are separately machined and formed from both ends in the longitudinal direction of the intake manifold 3, the required stroke of a machine for work can be made smaller, and thus machining is facilitated and finished in a short time. In addition, since each of the fuel circuits 3*a*, 3*b*, 3*c*, and 3*d* can be made shorter, and the needless volumes of the fuel circuits 3*a*, 3*b*, 3*c*, and 3*d* are eliminated, load on the fuel pump 7 is reduced and variations in the amount of injection of each cylinder is reduced, thus making it possible to improve the performance of the engine.

What is claimed is:

1. A fuel piping structure for a diesel engine having a cylinder head structure in which a fuel circuit is provided between a fuel tank and fuel injection nozzles for each cylinder head, wherein a part of said fuel circuit is formed inside an intake manifold with independent bores to each fuel injection nozzle in communication with a longitudinal bore.

2. The fuel piping structure for the diesel engine in accordance with claim 1, wherein the part of said fuel circuit is a part of a fuel return circuit running from said fuel injection nozzle to said fuel tank.

3. The fuel piping structure for the diesel engine in accordance with claim 1, wherein the part of said fuel circuit is a part of a fuel supply circuit running from said fuel tank to said fuel injection nozzles.

4. The fuel piping structure for the diesel engine in accordance with claim 2, wherein the part of said fuel circuit further includes a part of a fuel supply circuit running from said fuel tank to said fuel injection nozzles.

5. The fuel piping structure for the diesel engine in accordance with claim 3 or claim 4, wherein at least one of the part of said fuel supply circuit is formed inside said intake manifold; and wherein fuel supply lines, which are provided between said fuel tank and the part of the fuel supply circuit at least one of which is formed inside said intake manifold are connected to approximately center portions in longitudinal directions of said part of the fuel supply circuit at least one of which is formed inside said intake manifold.

6. The fuel piping, structure for the diesel engine in accordance with claim 3, wherein longitudinal portions of said intake manifold, which are in the part of said fuel supply circuit, are machined and formed from both end sides of said intake manifold in the longitudinal direction thereof.

7. The fuel piping structure for the diesel engine in accordance with claim 4, wherein at least one of the following: longitudinal portions of said intake manifold, which are in the part of said fuel supply circuit; and longitudinal portions of said intake manifold, which are in the part of said fuel return circuit, is machined and formed from both ends of said intake manifold in the longitudinal direction thereof.

8. The fuel piping structure for the diesel engine in accordance with claim 1, claim 2, claim 3, or claim 4, further comprising:

an intake manifold gasket which is attached between contact faces of said intake manifold and said cylinder head, and has fuel holes for connecting the fuel circuits respectively formed in said intake manifold and said cylinder head, said fuel holes each being formed by a rubber seal which is integrally fixed to said intake manifold gasket.

* * * * *